United States Patent [19]

Bednarz

[11] 4,264,845

[45] Apr. 28, 1981

[54] ORNAMENTAL LIGHT DISPLAY AND CIRCUIT THEREFOR

[75] Inventor: Robert W. Bednarz, New York, N.Y.

[73] Assignee: Electro-Harmonix, Inc., New York, N.Y.

[21] Appl. No.: 962,955

[22] Filed: Nov. 22, 1978

[51] Int. Cl.[3] ..... H05B 37/02; F21L 11/00

[52] U.S. Cl. ..... 315/323; 315/161; 315/176; 315/312; 362/104; 362/800; 362/806

[58] Field of Search ..... 315/200 A, 291, 294, 315/297, 312, 323, 161, 176; 84/464; 362/800, 810, 811, 104, 806; 340/148

[56] References Cited

U.S. PATENT DOCUMENTS 4,064,414 12/1977 Bergeson et al. ..... 315/291 X
4,161,018 7/1979 Briggs et al. ..... 362/104

FOREIGN PATENT DOCUMENTS 1328419 8/1973 United Kingdom ..... 315/312

OTHER PUBLICATIONS

Briar, *Discostrobe,* Practical Electronics, Nov. 1976, pp. 888–895.

Bear, *Chromachase* 4, Part 1, Practical Wireless, Dec. 1976, pp. 676–681.

*Primary Examiner*—Eugene R. La Roche
*Attorney, Agent, or Firm*—Eugene E. Geoffrey, Jr.

[57] ABSTRACT

The method and apparatus for producing ornamental lighting displays utilizing electronic circuitry in the nature of a commutator which responds to binary signals produced from a plurality of orderly and/or random sources of energy and functions to illuminate one or more light sources depending on the binary combinations produced by the energy sources. The light sources may be light emitting diodes or other light sources depending on the power available and may be arranged in a variety of ornamental patterns.

6 Claims, 6 Drawing Figures

Figures 1, 2:
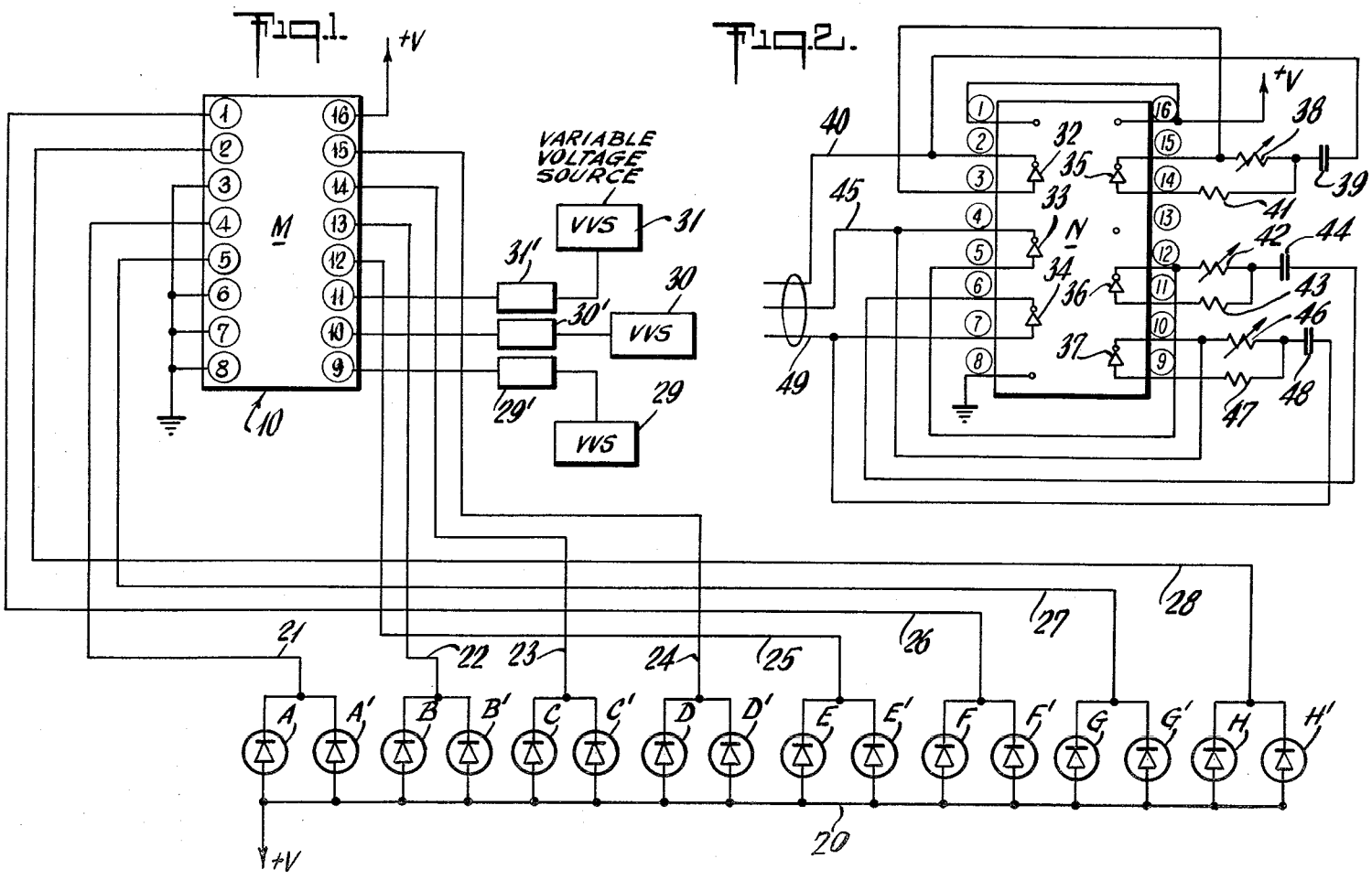

VARIABLE VOLTAGE SOURCE
VVS
+V
M
N

ORNAMENTAL LIGHT DISPLAY AND CIRCUIT THEREFOR

This invention relates to ornamental light displays and to a novel and improved method and circuit for illuminating lamps in orderly or substantially random patterns to provide interesting and attractive ornamental displays.

It is well known that light sources regardless of their nature can be arranged to be illuminated periodically to produce a wide variety of patterns. This has been accomplished through the utilization of commutators or other means such as RC circuits for the illumination of incandescent and gaseous lamps. In each instance however, the commutator or RC circuit necessarily functioned in an orderly manner so that any illuminated design was automatically reproduced periodically. Light sources have also been illuminated by various types of sound signals which involved the utilization of circuitry that would function in a response to selected frequencies to illuminate certain light sources in order to produce continuously varying displays including colored displays. Such devices are relatively complicated and expensive and are intended for relatively specific applications.

This invention provides a novel and improved circuit for illuminating light sources which will afford a great variety of displays and which may be readily controlled by a variety of sources of energy such as oscillators, sound waves, random noise signals and the like depending on the nature of the lighting display desired.

Another object of the invention resides in the provision of a novel and improved circuit which may be utilized to control the illumination of a plurality of light sources to obtain a great variety of patterns and is relatively inexpensive and compact and utilizes relatively small quantities of power to effect control of the light sources.

Another object of the invention resides in the provision of novel and improved circuitry for direct illumination of a plurality of light emitting diodes, LED, so that the entire display including the lamps and the control apparatus requires extremely small amounts of energy in order to effect the operation thereof.

A further object of the invention resides in the provision of a novel and improved method for producing ornamental lighting displays.

The invention in one of its aspects comprises an IC component in the form of a C-MOS-multiplexer arranged to receive a plurality of inputs for controlling light patterns and a plurality of outputs coupled to LEDs arranged in an ornamental design so that the inputs will function to periodically activate each of the light sources in a predetermined manner whether it be orderly or in the nature of a random operation. The invention further involves the utilization of a novel and improved oscillator circuit for developing a plurality of square wave outputs which may be utilized to activate the multiplexing unit.

The above and other objects and advantages of the invention will become more apparent from the following description and accompanying drawings forming part of this application.

IN THE DRAWINGS

Figure 3:
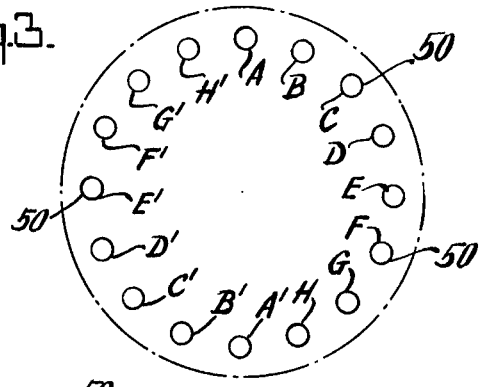
Figure 4:
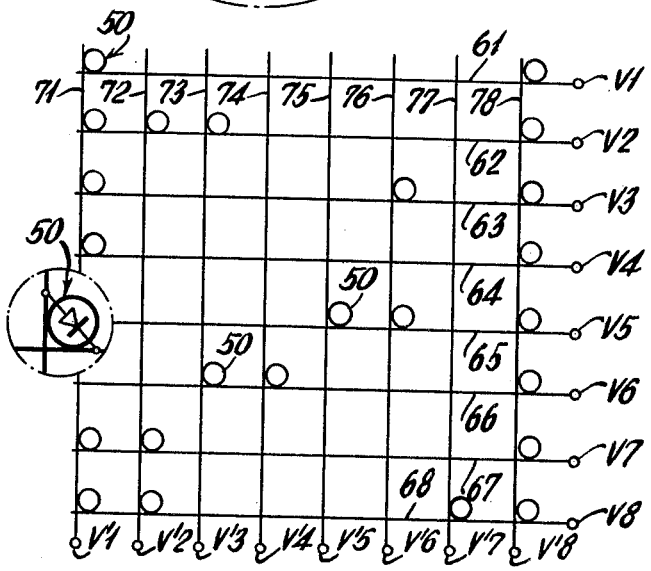
Figure 5:
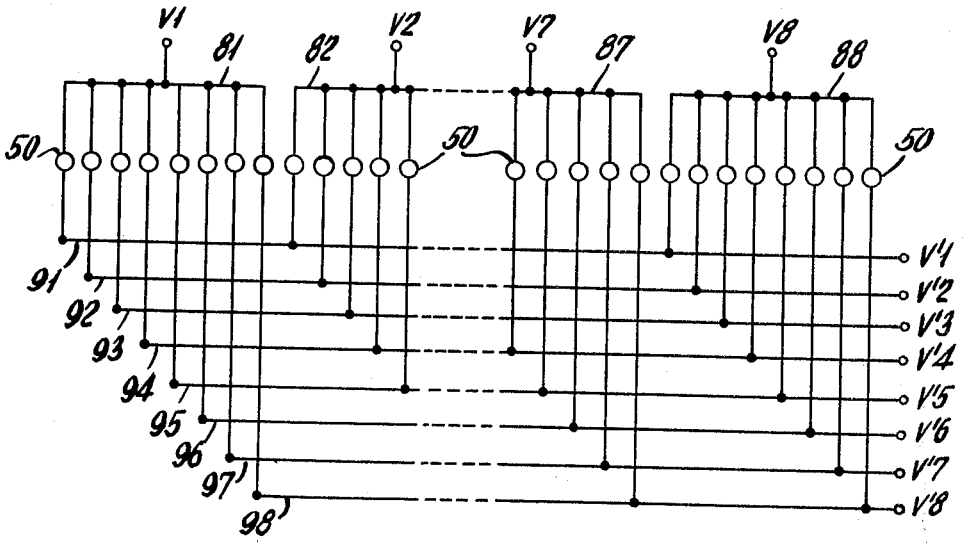
Figure 6:
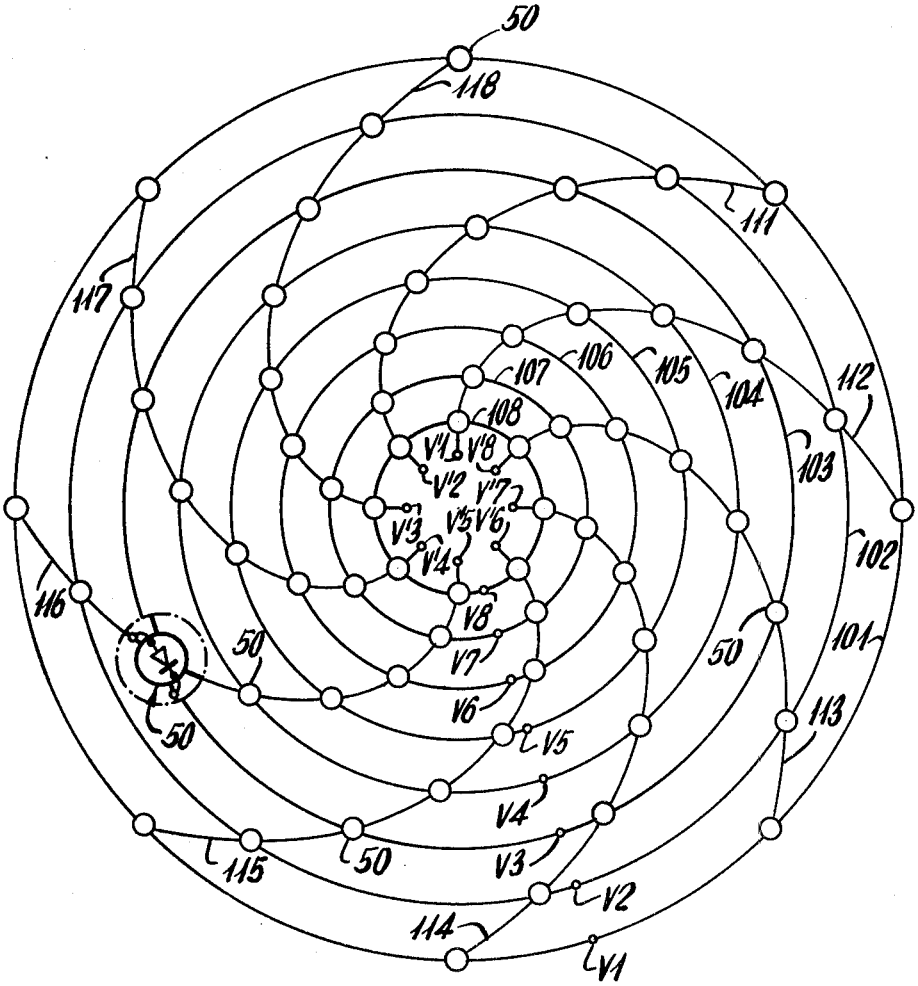

FIG. 1 is a circuit diagram for operating a plurality of light emitting diodes in accordance with the relative values of voltages applied to the inputs, FIG. 2 is a circuit for producing a plurality of square wave oscillator signals for operating a multiplexing circuit shown in FIG. 1, FIG. 3 is a plan view of a circular display of light sources activated by the circuit shown in FIG. 1, FIG. 4 is a rectangular display of light sources which may be activated by a circuit of the type shown in FIG. 1, FIG. 5 is a linear display of light sources which may be activated by a circuit of the type shown in FIG. 1, and FIG. 6 is a spiral lighting display which may be activated by a circuit of the type shown in FIG. 1.

Referring now to the drawings and more specifically to FIG. 1, the numeral M denotes a C-MOS-multiplexer No. 4051 which constitutes the single electronic element for controlling a plurality of LEDs from a plurality of input signals. Since this multiplexer is well known in the art, a detailed description of its structure is not deemed necessary.

A nine-volt source is connected between the input terminals 8 and 16 of the multiplexer with the positive side of the source being connected to the terminal 16 and the negative side of the source being grounded. The commutator terminal 3, the inhibit terminal 6 and the internal biasing terminal 7 are all coupled to the internal biasing terminal 8 and to ground.

In the instant embodiment of the invention, a plurality of 16 LEDs which may be arranged in any desired configuration are denoted by the numerals A through H and A′ through H′. The LEDs A and A′ are connected in parallel and similarly B-B′, C-C′ etc. are connected in parallel. All of the anodes of the LEDs A through H and A′ through H′ are connected to a common conductor 20 which in turn is connected to a suitable 9-volt source. The common connection between the cathode of the LEDs A and A′ is connected through a conductor 21 to the terminal 4 of the multiplexer M. Similarly, the cathodes B and B′, C and C′, D and D′, E and E′, F and F′, G and G′, H and H′ are connected through conductors 22 through 28 respectively to the terminals 13, 14, 15, 12, 1, 5 and 2 respectively of the multiplexer M. The terminals 9, 10 and 11 are connected to variable binary voltage sources 29, 30 and 31. These sources may be square wave oscillators with a variable frequency control or one or more of the sources may constitute a source of random noise, speech or music. In the case of noise, speech or music, suitable means 29′, 30′ and 31′ are preferably employed to produce binary outputs corresponding to peak voltages of a given magnitude or the envelopes of sound sources. In this way, illumination of the LEDs can be effected in either regular or random manners. Since the output of each of the voltage sources is in the form of a square wave, when the voltage sources function to produce outputs at different frequencies or intervals there can be a total number of eight different combinations of voltages which will function to illuminate one or more of the sets of lamps A and A′ through H and H′. In the instant embodiment of the invention, these combinations are as follows:

| COMBINATIONS OF VOLTAGES | NO. OF LAMPS ILLUMINATED |
|---|---|
| 000 | 1 |
| 001 | 2 |
| 010 | 3 |
| 011 | 4 |
| 100 | 5 |
| 101 | 6 |
| 110 | 7 |
| 111 | 8 |

One example of means for generating three square wave oscillator signals is illustrated in FIG. 2 and utilizes a hex-inverter No. 4009 and denoted by the letter N. In this embodiment of the invention, a 9-volt source is connected between the terminals 8 and 16 with the terminal 8 being grounded and the terminal 16 being connected to the positive side of the voltage source. The terminal 1 is also connected to the positive side of the 9-volt source. Invertors 32 through 37 are connected respectively between terminals 2-3, 4-5, 6-7, 15-14, 12-11 and 9-10. The terminal 15 is connected to the terminal 3 and to one side of a variable resistor 38. The terminal 14 is connected through a resistor 41 to the other side of the variable resistor 38 and thence through a capacitor 39 to the terminal 2 which also constitutes one square wave output which is coupled by a lead 40 to the terminal 10 of the multiplexer illustrated in FIG. 1. The terminal 12 is connected to one side of a variable resistor 42 and to the terminal 5. The terminal 11 is connected through a resistor 43 to the other side of the variable resistor 42 and thence through a capacitor 44 to the terminal 4 and to an output lead 45 which is connected to the terminal 11 of the multiplexer of FIG. 1. The terminal 10 is connected to one side of the variable resistor 46 and also to the terminal 7. The terminal 9 is connected through a resistor 47 to the other side of the variable resistor 46 thence through a capacitor 48 to the terminal 6 and to the output lead 49 which may be connected to the terminal 9 of the multiplexer of FIG. 1. Each of the oscillator signals can be adjusted in frequency by the variable resistors 38, 42 and 46 and are preferably arranged to be adjusted within a frequency range of 1 Hertz to 100 Hertz.

With the foregoing arrangement, it is evident that the LEDs may be illuminated individually or in groups in any desired orderly or random sequence and may be arranged in a variety of configurations to produce interesting ornamental effects. While LEDs simplify the circuitry because of the relatively low power requirements, it is possible to use the binary signals to operate lamps having greater power requirements.

The LEDs A and A' through H and H' may be arranged in a variety of arrays as illustrated for instance in FIGS. 3 through 6.

FIG. 3 illustrates a circular array of LEDs wherein each pair of LEDs connected in parallel such as A and A' are positioned in diagonally opposing locations. The same applies to B-B', C-C' etc. With this arrangement and even though three square wave oscillators, such as that shown in FIG. 2, may be utilized, a variety of lighting displays may be obtained simply by adjusting the frequencies of the individual oscillators. It is also evident that a similar display could be utilized with only eight lights or if desired multiple numbers of eight. By utilizing sound or noise sources alone or in combination with an oscillator source, a still wider variety of displays may be obtained which would be clearly in the nature of random operation.

FIG. 4 illustrates a rectangular arrangement of lamps wherein a total of sixty-four LEDs 50 are employed. In this case, a plurality of horizontal conductors are denoted by the numerals 61 through 68 while the vertical conductors are denoted by the numerals 71 through 78. Each of the sixty-four LEDs is connected at each intersection between the horizontal and vertical conductors with like electrodes being connected to the horizontal conductors and like electrodes being connected to the vertical conductors. For instance, all cathodes may be connected to the horizontal conductors while all anodes may be connected to all vertical conductors. For this display, two sets of signals V1 through V8 and V'1 and V'8 are utilized. The signals V1 through V8 may be obtained from the conductors 21 through 28, as shown in FIG. 1, connected to the multiplexer M. The signals V'1 and V'8 would be obtained from a second identical multiplexer as shown in FIG. 1 which could be fed from the same or different source signals. With this arrangement, at any time that the signal V1 for instance is negative and V'1 is positive, then the LED at the intersection of the two conductors would be illuminated. If both signals however are either 1 or 0 then of course there would be no voltage difference and the LED would not be illuminated. Similarly, if the signals V1 and V'1 were of reversed polarity, the LED would not be illuminated. With such an arrangement an extremely wide variety of displays can be obtained depending on the nature of the signals being introduced. It would also be possible for instance to shunt all of the vertical conductors and connect them to the positive side of a voltage source in which case a signal multiplexer as illustrated in FIG. 1 could be utilized to provide the voltages V1 through V8.

FIG. 5 shows a modified arrangement of the LEDs 50 wherein they are arranged in a linear array. This wiring arrangement is similar to that described in connection with FIG. 4 in that one group of LEDs 50 is connected between the conductor 81 and conductors 91 through 98. Similarly, the second group of eight LEDs 50 is connected between the conductor 82 and the conductors 91 through 98. The remaining groups of LEDs are similarly connected between each of the conductors 83 through 88 and the corresponding conductors 91 through 98 as in the previous cases. The conductors 81 through 88 are energized by voltages V1 through V8 as in the case of FIG. 4 while the conductors 91 through 98 are energized by voltages V'1 through V'8 as previously described and the sources for both sets of voltages may comprise a pair of multiplexing circuits as illustrated in FIG. 1 which could be driven by any type of binary voltage source or combinations thereof.

A still further form of display as illustrated in FIG. 6. In this case, there are a plurality of concentric conductors 101 through 108 and a plurality of spiral conductors 111 through 118. The spiral conductors are positioned above and insulated from the concentric conductors and an LED 50 is connected at each intersection between the spiral and concentric conductors. In operation, one set of voltages V1 through V8 is applied to conductors 101 through 108 while the second set of voltages is applied to the spiral conductors 111 through 118. These voltages would be the same as previously described in connection with FIGS. 4 and 5.

With the foregoing description of the invention, it is apparent that a wide variety of ornamental lighting designs can be obtained utilizing a binary system for illuminating the lamps. It is also evident that while planar displays have also been illustrated, three-dimensional displays may also be produced utilizing the system of control as described above.

While only certain embodiments of the invention have been illustrated and described, it is apparent that alterations, changes and modifications may be made without departing the true scope and spirit thereof.

What is claimed is:

1. Apparatus for producing an ornamental light display comprising a plurality of light sources arranged to form an ornamental pattern, a plurality of generating means for producing a plurality of sets of binary input signals of different periodicities, means for sensing the successive changes in the orders of binary bits produced by said signals and producing a set of binary output signals and means for feeding said output signals to said light sources for illuminating selected light sources with each specific order of bits being sensed, second sensing means, means for feeding a plurality of binary input signals to said second sensing means whereby the last said sensing means produces a second set of binary output signals and each of said light sources is connected between selected output terminals of the first said and second sensing means and illuminated each time a voltage difference occurs across each light source.

2. Apparatus for producing an ornamental light display according to claim 1 wherein said light sources are LEDs.

3. Apparatus for producing an ornamental light display according to claim 1 wherein said generating means comprises a plurality of square wave oscillators for producing said sets of binary input signals and means for individually adjusting the frequency of each oscillator.

4. Apparatus for producing an ornamental light display according to claim 1 wherein at least one of said generating means comprises a source of substantially randomly varying signals such as noise, voice, music and the like and means for producing a square wave signal in accordince with a characteristic of the randomly varying signals.

5. Apparatus for producing an ornamental light display according to claim 1 wherein said light sources are arranged in a rectangular array.

6. Apparatus for producing an ornamental light display according to claim 1 wherein said light sources are arranged in a spiral array.

* * * * *